US007458899B2

(12) United States Patent
Michaud

(10) Patent No.: US 7,458,899 B2
(45) Date of Patent: Dec. 2, 2008

(54) PUTTER TRAINING APPARATUS AND METHOD OF USE

(76) Inventor: Mark David Michaud, 91 King's Drive, Singapore (SG) 266458

( * ) Notice: Subject to any disclaimer, the term of this patent is extended or adjusted under 35 U.S.C. 154(b) by 0 days.

(21) Appl. No.: 11/359,040

(22) Filed: Feb. 21, 2006

(65) Prior Publication Data

US 2007/0197308 A1 Aug. 23, 2007

(51) Int. Cl.
*A63B 69/36* (2006.01)

(52) U.S. Cl. ..... 473/226; 473/138; 473/235; 473/340

(58) Field of Classification Search ..... 473/147, 473/219, 223, 226, 229, 230, 235, 250, 138, 473/139, 145, 146, 286, 340, 341, 345, 350
See application file for complete search history.

(56) References Cited

U.S. PATENT DOCUMENTS 3,300,241 A * 1/1967 Eberwein et al. ..... 294/19.2
3,434,722 A * 3/1969 Esposito ..... 473/235
3,708,172 A * 1/1973 Rango ..... 473/249
3,841,639 A * 10/1974 Werner ..... 473/286
3,999,765 A 12/1976 Bishop
4,147,357 A 4/1979 Strop
4,976,436 A * 12/1990 Serizawa ..... 473/286
5,375,833 A 12/1994 Marier, Jr.
5,485,999 A * 1/1996 Hull et al. ..... 473/286
6,702,688 B2 * 3/2004 Hale ..... 473/226
6,863,617 B2 * 3/2005 Park ..... 473/226

* cited by examiner

*Primary Examiner*—Nini Legesse
(74) *Attorney, Agent, or Firm*—Raymond M. Galasso; Galasso & Associates, LP

(57) ABSTRACT

A putter training apparatus and method of use are provided. In one form, a putter training apparatus includes a putter head generally formed as a mallet attached to a standard golf shaft. The putter head includes an opening through the vertical distance of the putter head, generally centered in the putter head. The putter head further includes a standard golf ball, generally centered within the opening. The golf ball is attached to an extension and retraction system comprising two spherical seats inserted in the heel side and toe side of the opening and two ligaments connecting the spherical seats to the golf ball. The extension and retraction system allows the golf ball to extend from the opening during use, and remain visible to the user through the opening, as long as the user employs a smooth, in line, and in tempo putting stroke.

5 Claims, 3 Drawing Sheets

PUTTER TRAINING APPARATUS AND METHOD OF USE

FIELD OF THE DISCLOSURE

The invention generally relates to golf, and more particularly to a putter training apparatus and method of use.

BACKGROUND

Golf has a long history, dating back to the 1400s. The inherent difficulty of the game and enjoyment of improving one's skills have much to do with the ever increasing popularity of the sport. More and more golf courses have opened in the United States over the past few decades, offering everything from expensive private golf clubs, to local municipal golf courses, to smaller par-3 golf courses.

The sport of golf is comprised of three primary facets, driving the ball from the tee, using a range of woods and irons to get the golf ball onto the putting green, and finally putting the ball into the hole. All facets provide unique challenges, but one can easily double one's score for a hole just on the putting green without a mastery of the skills required for successful putting. These skills include not only being able to putt the ball straight, but also require a smooth stroke with correct tempo and a sense of rolling the ball, instead of merely striking the ball which can lead to incorrect follow through. There are many putting aids on the market that provide feedback as to whether or not a putting stroke is straight. What is needed, however, is a putting training aid that provides feedback on whether or not a putt is straight, whether or not the stroke is smooth and in tempo, and that provides a sensation of rolling the golf ball, rather than merely striking it.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DESCRIPTION

A putter training apparatus and method of use are provided. In one form, a putter training apparatus includes a putter head generally formed as a mallet and coupled to a standard golf shaft. The putter training apparatus further includes a standard golf ball placed within an opening of the mallet and viewable to a user. The putter training apparatus further includes a golf ball extension and retraction system coupled to the mallet and the golf ball.

According to another aspect of the invention, a putter training apparatus includes a putter head formed generally formed as a mallet and coupled to a standard golf shaft. The putter training apparatus further includes a standard golf ball placed within an opening of the mallet and coupled to a golf ball extension and retraction system. The extension and retraction system enables an extension of the golf ball from the opening.

According to a further aspect of the invention, a putter training apparatus and method of use are provided. The putter training apparatus includes a putter head formed generally formed as a mallet and coupled to a standard golf shaft. The putter training apparatus further includes a standard golf ball placed within an opening of the mallet and viewable to a user, and a golf ball extension and retraction system coupled to the mallet and the golf ball and operable to enable an extension of the golf ball from the opening during a back stroke and a forward stroke of the putter head.

Figure 1:
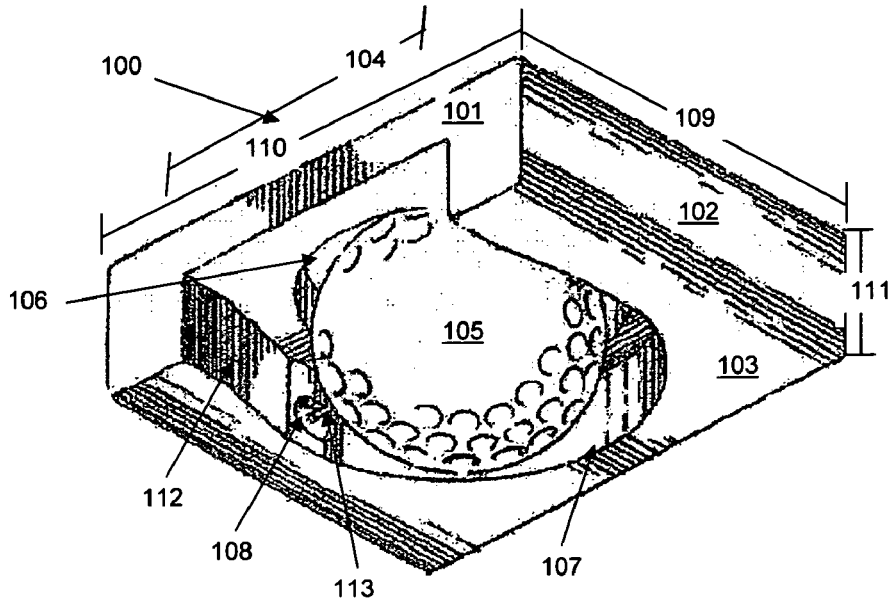
FIG. 1 illustrates a rear perspective view of a putter training apparatus in accordance with one aspect of the invention.

FIG. 1 illustrates a rear bottom perspective view of a putter training apparatus in accordance with one aspect of the present invention. A putter head of the putter training apparatus is illustrated generally at 100. Putter head 100 is generally shaped as a mallet and may be attached to a putter shaft (not expressly shown). Putter head 100 further includes a rear side 101 of opposite a front side (not expressly shown). Putter head 100 also includes a toe side 102 opposite a heel side (not expressly shown) and a bottom side 103 opposite a top side (not expressly shown). Putter head 100 further includes a cutaway portion 104 of putter head 100 extending substantially toward bottom side 103 along rear side 103 of putter head 100. Cutaway 104 enables standard golf ball 105 to exit putter head 100 during a back stroke and a forward stroke of putter head 100. Golf ball 105 is generally centered within opening 106 and opening 106 is generally centered within putter head 100. Opening 106 allows a user to view golf ball 105 along a top portion of putter head 100 during use (not expressly shown).

Putter head 100 further includes a golf ball extension and retraction system illustrated generally at 108 coupled to golf ball 105 along a side portion of golf ball 105 and aligned with a side portion 112 of putter head 100. Extension and retraction system 108 includes a cable or wire 113 coupled to a side portion of golf ball 105 and in one embodiment may extend through golf ball 105 and to toe side 102. Putter head 100 further includes bottom opening 107 extending to cutaway portion 104 along the rear side 101 of putter head 100, forming a "U" shaped opening generally centered along bottom side 103 of putter head 100. Extension and retraction system 108 allows golf ball 105 to extend from opening 107 and cable 113 may be extended to a maximum distance of approximately twelve (12) inches from putter head 100 when putter head 100 is moved in a backward or forward direction. Additionally, golf ball 105 will be retracted into opening 107 when transitioning between a back stroke and a forward stroke, or when putter head 100 is at rest. Extension and retraction system 108 and top opening 106 and bottom opening 107 allow golf ball 105 freedom of movement in a horizontal and a vertical direction during use and encourages a smooth putting stroke with consistent tempo to provide a user the sensation of rolling golf ball 105 rather than striking it. Opening 106 allows a user to view golf ball 105 during a backward and forward stroke.

Putter head 100 may include a width 109 of at least two (2) inches and no more than four (4) inches, extending from rear side 101 to a front side (not expressly shown). Putter head 100 may further include a length 110 of at least three (3) inches and no more than five (5) inches, extending from toe side 102 to a heel side (not expressly shown) and a height 111 of at least one half (½) inch and no more than two (2) inches, extending from bottom side 103 to a top side (not expressly shown). In one embodiment, putter head 100 may include a mallet formed from steel and have dimensions of two (2) inches by three (3) inches by one half (½) inch. In another embodiment, putter 100 may be formed from any material generally found in putter head including but not limited to stainless steel, carbon steel, brass, polymers, plastics, and graphite. In another embodiment, putter head 100 may include extension and retraction system 108 formed as wire retractably attached to ball bearings and coupled to golf ball 105. In another embodiment, putter head 100 may include extension and retraction system 108 formed as elastic material attached to golf ball 105.

During use, a user desires to achieve a smooth putting stroke and a user may grasp putter shaft (not expressly shown) attached to putter head 100 and align putter head 100 with the desired putting location such as a cup, a hole, a pin, practice green, or any other object that will allow a user to determine whether or not golf ball 105 followed a desired path or putting line. A user may view golf ball 105 through top opening 106 when setting up for a putt and as a user moves putter head 100 to achieve a smooth putting stroke golf ball 105 remains in a user's view through top opening 106 while extending from extension and retraction system 108. During a smooth forward stroke, a user will also see golf ball 105 through top opening 106. However, if a user moves putter head 100 too quickly or in a non-linear fashion, golf ball 105 will disappear from a user's view through top opening 106. For example, as a user brings putter head 100 in a backward direction too quickly during a backstroke, extension and retraction system 108 allows golf ball 105 to extend from opening 107 up to a distance of approximately twelve (12) inches. As a user brings putter head from the back stroke to a neutral position, extension and retraction system 108 retracts golf ball 105 into opening 107 and as a user continues moving putter head 100 from a neutral or center position to a forward stroke, golf ball 105 again extends from opening 107 using extension and retraction system 108 to a maximum distance of twelve (12) inches from putter head 100 if a user's forward stroke is too quick. In this manner, a user is provided a visual feedback of a putting stroke that is too fast, unstable, etc. allowing a user to achieve a smooth putting stroke.

Figure 2:
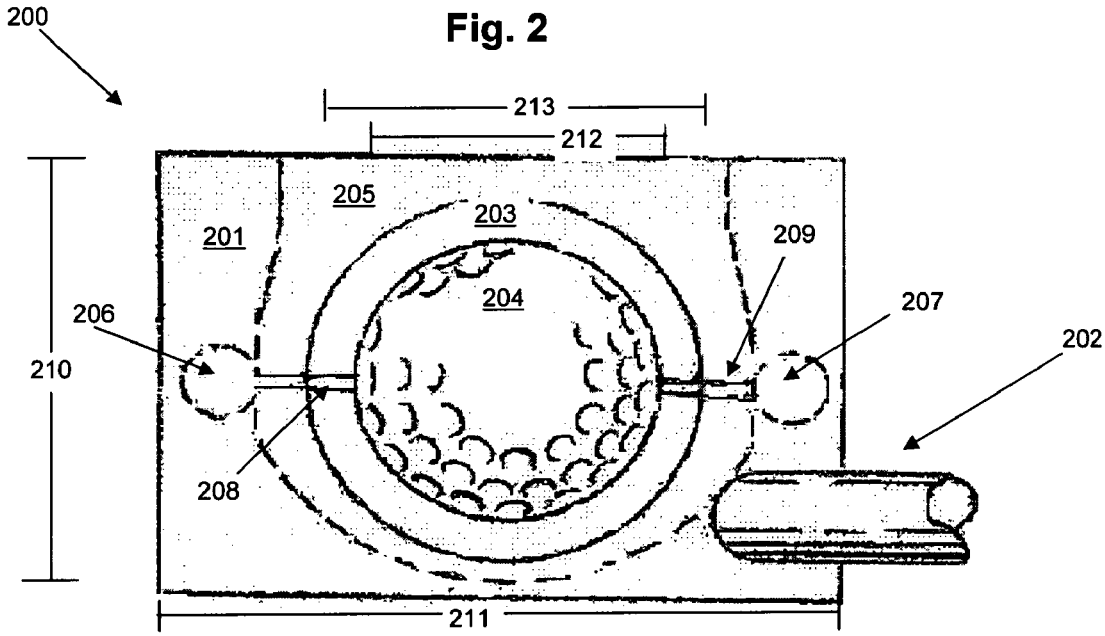
FIG. 2 illustrates a top perspective view of a putter training apparatus in accordance with one aspect of the invention.

FIG. 2 illustrates a top perspective view of a putter training apparatus in accordance with one aspect of the present invention. A putter training apparatus is illustrated generally at 220 and includes a putter head 200 generally formed as a mallet and attached to a putter shaft 202. Putter head 200 includes a top side 201 opposite a bottom side of the mallet (not expressly shown). Putter head 200 further includes a top opening 203, generally centered to putter head 200 and sized larger than standard golf ball 204. Putter head 200 also includes a bottom opening 205, sized larger than top opening 203. Bottom opening 205 allows golf ball 204 to exit putter head 200 during use. Putter head 200 also includes a toe side 214 of putter head 200 opposite a heel side 215, and a front side 216 opposite a rear side 217.

Standard golf ball 204 is coupled to a golf ball extension and retraction system that includes a first spherical seat 206 coupled to a first ligament 208 and a second spherical seat 207 coupled to second ligament 209. First spherical seat 206 is located generally toward toe side 214 of putter head 200 and second spherical seat 207 is located generally toward heel side 215 of putter head 200. First spherical seat 206 is coupled to first ligament 208 and a portion of golf ball 204 along a center portion of golf ball 204. Similarly, second spherical seat 207 is coupled to second ligament 209 and a center of golf ball 204

In one embodiment, putter head 200 includes a width 210 of at least two (2) inches and no more that four (4) inches and a length 211 of at least three (3) inches and no more than four (4) inches. Standard golf ball 204 includes a diameter 212 of approximately one and sixty-eight hundredths (1.68) inches. Opening 203 further includes a diameter 213 between one and seven hundredths (1.7) inches and two and one half (2.5) inches.

During use, a user generally stands in a normal putting stance with feet apart, knees slightly bent, both hands on the putter, and feet in alignment with the desired direction of a putt. A user starts in a neutral position by gripping shaft 202 so that putter head 200 is located generally proximal or on the ground and centered between but out in front of a user's feet. If a user is right-handed, front side 216 will be toward a user's left. If a user is left-handed, front side 216 will be toward a user's right. A user then takes a back stroke. If a user is right handed, this consists of bringing the putter slowly back to the right. If a user is left-handed, this consists of bringing the putter slowly back to the left. During the back swing, golf ball 204 may extend from bottom opening 205 to a maximum distance of twelve (12) inches. For example, during a smooth back stroke, golf ball 204 remains visible to a user through top opening 203. It the swing is off-line or off-tempo, golf ball 204 may become partially or completely obscured by putter head 200 while extended up to twelve (12) inches from putter head 200. After completion of the back stroke, a user initiates a fore stroke by swinging putter head 200 in the opposite direction of the back stroke, causing putter head 200 to pass the neutral position to a position forward of the neutral position. As putter head 200 approaches the ground at the neutral position, golf ball 204 retracts (if extended) into top opening 203. As putter head 200 rises from the ground during the forward stroke, golf ball 204 again extends from bottom opening 205 to a maximum distance of twelve (12) inches depending on the tempo and line of putter head 200. For example, golf ball 204 will remain visible during extension to a user through top opening 203 as long as the stroke is in-line and in-tempo. However, as if a fore stroke is off-line or off-tempo, golf ball 204 may extend up to twelve (12) inches from putter head 200. At the completion of the stroke, golf ball 200 will again retract into opening 200, becoming once again centered in top side 201.

In one embodiment, first spherical seat 206 and second spherical seat 207 comprise a metal, plastic polycarbonate material, etc. For example, first spherical seat 206 and second spherical seat 207 may include a metallic bearing or ball bearing. In one embodiment, first ligament 208 and second ligament 209 may include a metal strand material, elastic material, cable, filament, etc. Ligaments 208 and 209 may be coupled directly to golf ball 204 using a fastener, glue, epoxy, etc. (not expressly shown). In another embodiment, ligaments 208 and 209 wrap around a circumference of golf ball 204 or may extend through a cavity or channel within golf ball 204.

Figure 3:
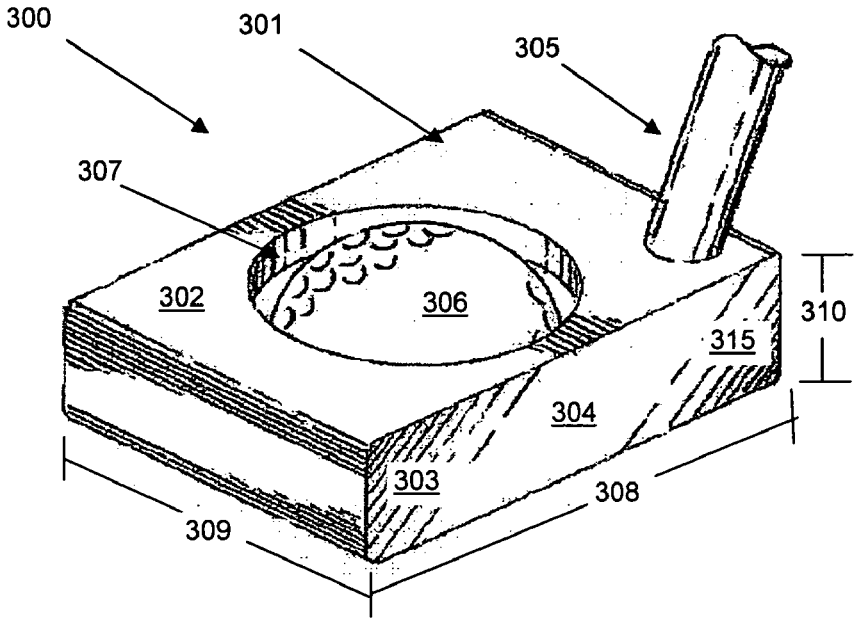
FIG. 3 illustrates a top perspective view of a putter training apparatus in accordance with another aspect of the invention.

FIG. 3 illustrates a putter training apparatus in accordance with one aspect of the present invention. A putter training apparatus is illustrated generally at 300 and includes a putter head 301, which is generally formed as a mallet. Putter head 301 is coupled to a putter shaft 305 and includes a top side 302 opposite a bottom side (not expressly shown), a toe 303 opposite a heel 315, and a front side or face 304 of putter head 301 opposite a rear side (not expressly shown). Shaft 305 is attached to top side 302 generally toward a comer formed by the front side 304 and the rear side (not expressly shown), although other locations along putter head 301 may also be used. Shaft 305 allows a user to practice a putting swing with the putter training apparatus 300 by stroking putter training apparatus 300 much as a user would swing a conventional golf putter. In one embodiment, shaft 305 may be steel or an alloy material. In another embodiment, shaft 305 may include wood, graphite, or any other type of material that may formed into a putter shaft.

Putter head 301 also includes a golf ball 306 coupled to putter head 301 and extending through opening 307. Golf ball 306 is generally centered within opening 307, which includes a diameter that is larger than golf ball 306 and allows for golf ball 306 to move within opening 307. Opening 307 is generally centered in top side 302 although other locations may be employed and allows a user to receive feedback on the quality of their golf swing by observing the position of the golf ball relative to opening 307.

In one embodiment, putter head 301 includes a length 308 of at least three (3) inches and no more than five (5) inches, representing the portion of putter head 301 between toe side 303 and a heel side (not expressly shown). Putter head 301 further includes a width 309 of at least two (2) inches and no more than four (4) inches, representing the portion of putter head 301 between front side 304 and a rear side (not expressly shown). Putter head 301 further includes a height 310 of at least one half (½) inch and no more than two (2) inches, representing the portion of putter head 301 between top side 302 and a bottom side (not expressly shown).

In one embodiment, putter head 301 may be shaped generally as a straight-sided polygon. In another embodiment, putter head 301 may have curved sections, as many modern putters do. A shape of putter head 301 could be manufactured to replicate a shape of any putter created and shaft 305 could be made of any material used to manufacture any other putter shaft to provide a user consistency between putter training apparatus 300 and a user's normal putter.

During use, a user grips shaft 305 and takes putting apparatus 300 through a back stroke segment and a forward stroke segment of a normal putting stroke. A user views golf ball 306 through opening 307. If the stroke is smooth and in line, golf ball 306 will remain visible through opening 307 through the entire stroke. Front side 303 may be used to align the shot, as it is a straight edge and will point in the direction that golf ball 306 would go during a putting stroke. However, if a user's putting stroke is not smooth, gold ball 306 will extend away from putter head 301 through a bottom/rear opening of putter head 301 (not expressly shown) indicating to a user that a putting stroke is too fast or offline.

Figure 4:
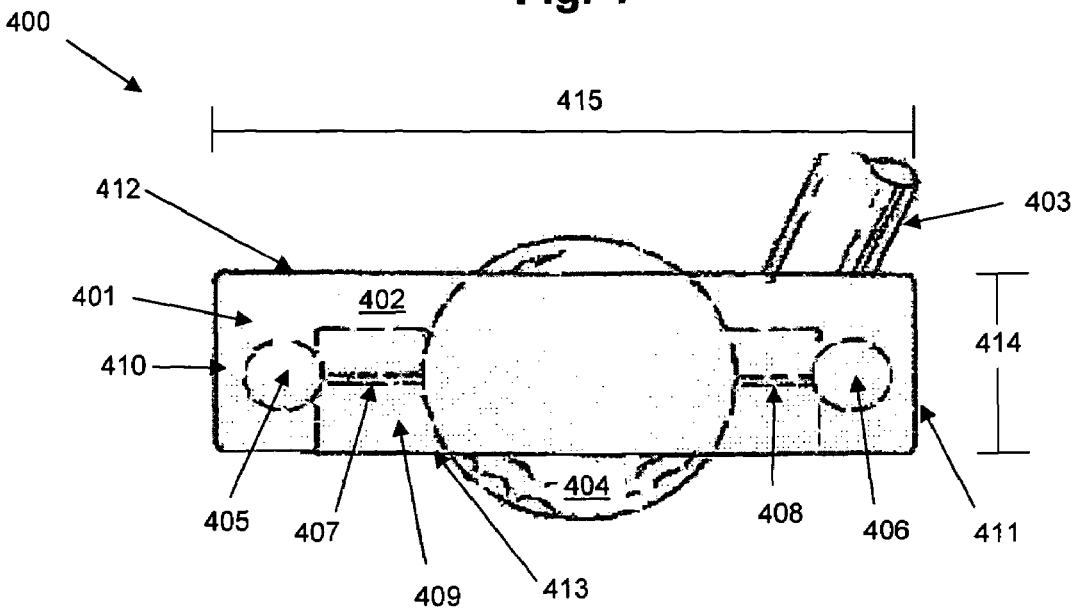
FIG. 4 illustrates a side perspective view of a putter training apparatus in accordance with one aspect of the invention.

FIG. 4 illustrates a front perspective view of a putter training apparatus in accordance with one aspect of the present invention. A putter training apparatus is illustrated generally at 400. Putter training apparatus 400 includes putter head 401 coupled to a standard putter shaft 403. Putter head 401 also includes a front side or face 402 opposite a rear side (not expressly shown).

Putter head 401 includes golf ball 404 attached to a golf ball extension and retraction system including a first ball bearing 405, a second ball bearing 406, a first ligament 407, and a second ligament 408. First ball bearing 405 is located generally toward a toe 410 of putter head 401 and is coupled to first ligament 407, which is in turn coupled to golf ball 404. Golf ball 404 is generally centered along putter head 401. Second ball bearing 406 is coupled to a heel 411 of putter head 401. Second ball bearing 406 is coupled to second ligament 408, which is in turn coupled to golf ball 404. Second ligament 408 is generally coupled to golf ball 404 along a center portion of golf ball 404. Extension and retraction system of golf training apparatus 400 allows golf ball 404 to exit putter head 401 along a cutaway portion 409 located toward bottom side 413 and rear side of putter head 401 (not expressly shown).

In one embodiment, putter head 401 includes a length 415 of at least three (3) inches and no more than five (5) inches, representing the portion of putter head 401 between toe side 410 and heel 411. Putter head 401 further includes a height 414 of at least one half (½) inch and no more than two (2) inches, representing the portion of putter head 401 between top side 412 and bottom side 413. Golf ball 405 extends through height 414 of putter head 401.

First bearing 405 and a second 406 may include a clutch mechanism, controlling the amount of first ligament 407 and second ligament 408 allowed to unwind from first bearing 405 and second bearing 406, controlling the distance golf ball 404 may extend from putter head 401.

During use, a user grips shaft 403 to take putter training apparatus 400 through a normal putting stroke. When a user is addressing the ball, a user holds putter training apparatus 400 so that putter head 401 is positioned slightly off the ground. At this point, golf ball 404 protrudes above top side 412 and below bottom side 413. During the stroke, as putter head 401 rises, first ball bearing 405 and second ball bearing 406 allow first ligament 407 and second ligament 408 to extend along with golf ball 404, so that golf ball 404 rolls along with the stroke. When putter head 401 returns to the ground, first ball bearing 405 and second ball bearing 406 retract first ligament 407 and second ligament 408, retracting golf ball back into the opening in putter head 401 (not expressly shown).

Figure 5:
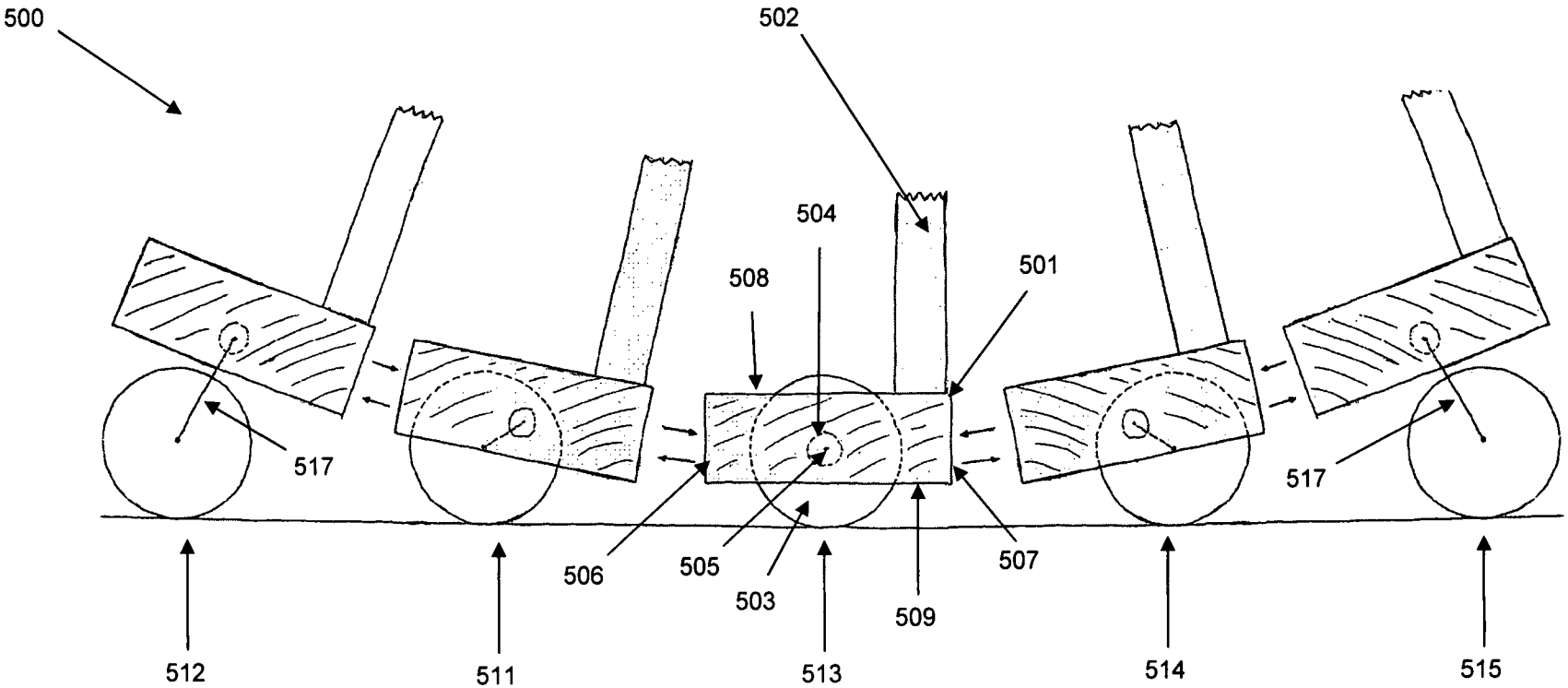
FIG. 5 illustrates a method of using a putter training apparatus in accordance with one aspect of the invention.

FIG. 5 illustrates a method of using a putter training apparatus in accordance with one aspect of the present invention. A method of using a putter training apparatus is illustrated generally at 500. A putter training apparatus 500 includes a putter head 501 attached to putter shaft 502 coupled to a top side 508 of putter head 501. Putter head 501 further includes a front side 507 opposite a rear side 506 a heel opposite a toe (not expressly shown).

Putter head 501 also includes a standard golf ball 503 centered within an opening of putter head 501 and extending from top side 508 generally centered along putter head 501 to a bottom side 509 of putter head 501. Golf ball 503 is coupled to a golf ball extension and retraction system 505 coupled to putter head 501 that includes a first spherical seat 504 coupled to a first ligament 517 and an opposing second spherical seat coupled to a second ligament (not expressly shown).

During use, a user stands in a normal putting stance with feet apart, knees slightly bent, both hands on the putter, and feet in alignment with the desired direction of a putt. A user starts in a neutral position 513 by gripping shaft 502 so that putter head 500 is located generally on the ground, and generally centered between but out in front of a user's feet. If a user is right-handed, front side 507 will be toward a user's left. If a user is left-handed, front side 507 will be toward a user's right. A user then takes a back stroke. If a user is right handed, this consists of bringing the putter slowly back to the right. If a user is left-handed, this consists of bringing the putter slowly back to the left. During the back stroke, a user takes putter head 501 through a first back position 511. At position 511, golf ball 503 begins to extend from putter head 501 through a bottom opening of putter head 501. A "U" shaped opening (not expressly shown) at the junction of rear side 506 and bottom side 509 may be used to provide an exit for golf ball 503 from putter head 501. First spherical seat 504 and a second spherical seat (not expressly shown) allow an extension of first ligament 517 and a second ligament (not expressly shown) enabling golf ball 503 to extend from putter head 501 while remaining attached to putter head 501. As a user completes the back stroke, bringing putter head 501 to second back position 512, golf ball 503 extends fully to a distance not to exceed twelve (12) inches from putter head 501. If a user employs a smooth in-line and in-tempo back stroke, golf ball 503 will remain visible to a user for the duration of the back swing via a top opening in putter head 501 (not expressly shown). However, if a user's back stroke is too fast or off-line, golf ball 503 extends past putter head 503 and may not be visible though an opening of putter head 503.

As a user brings putter head 501 through neutral position 513, golf ball 503 is retracted into a bottom opening of putter head 501 using extension and retraction system 505. For example, if a back stroke is on-line, putter head 501 may retract smoothly into putter head 501. However, if a back stroke is off line, golf ball 503 may become incident to bottom side 509 of putter head 501 and may not retract entirely into a cavity of putter head 501. In this manner, a user may be provided feedback on the accuracy and tempo o a back stroke for putting a golf ball and adjust accordingly.

As a user move putter head 501 to first forward position 514, an extension and retraction system comprising first spherical seat 504 and first ligament 505 and a second spherical seat and ligament (not expressly shown) allow an extension of golf ball 503 from putter head 501. For example, a "U" shaped opening (not expressly shown) along rear side 506 and bottom side 509 facilitates an exit of golf ball 503 from putter head 501. As a user brings putter head 501 through first forward position 514 into second forward position 515, golf ball 503 extends to a maximum distance of twelve (12) inches from putter head 501, depending on the overall speed of a desired putt. If a user maintains a smooth in line in tempo stroke, golf ball 501 remains visible to a user through a top opening (not expressly shown) in putter head 501. For example, if a user is off-line, as golf ball 503 extends from putter head 501, golf ball 503 may be skewed to the left or right of putter head 501 and as such golf ball 503 may not be entirely visible through a top opening of putter head 501. In this manner, a user may be provided visual feedback as to whether a conventional golf ball will be on-line or off-line upon completing a golf stroke.

In one embodiment, first ligament 505 and a second ligament (not expressly shown) are retractably attached to first spherical seat 504 near heel of putter head 501 and a second spherical seat (not expressly shown) attached along toe of putter head 501 (not expressly shown) set within a centered opening (not expressly shown) inside putter head 501. First ligament 505 and second ligament (not expressly shown) may be coupled directly to golf ball 503, or may wrap a circumference of golf ball 503 or extend through a cavity or channel (not expressly shown) bisecting golf ball 503. At the full twelve (12) inch extension of golf ball 505, spherical seat 504 will initiate a retraction of first ligament 505 and a second ligament (not expressly shown), retracting golf ball 503 into an opening (not expressly shown) in putter head 501 as a user brings putter head 501 from second back position 512 through first back position 511 and into neutral position 513.

Note that although an embodiment of the invention has been shown and described in detail herein, along with certain variants thereof, many other varied embodiments that incorporate the teachings of the invention may be easily constructed by those skilled in the art. Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. Accordingly, the invention is not intended to be limited to the specific form set forth herein, but on the contrary, it is intended to cover such alternatives, modifications, and equivalents, as can be reasonably included within the spirit and scope of the invention.

What is claimed is:

1. A putter training apparatus comprising:

a putter head generally formed as a mallet and coupled to a standard golf shaft;

a top opening generally centered within said putter head; said top opening being larger than the size of a standard golf ball; said top opening operable to provide a visual of the standard golf ball during the swing;

a "U" shaped bottom operable to allow said golf ball to exit said putter head during use;

a standard golf ball placed within said top opening or said "U" shaped bottom opening of the mallet; and a golf ball extension and retraction system coupled to the mallet and the golf ball and operable to enable an extension of the golf ball from the opening, wherein the extension and retraction system comprises a bearing and wherein the extension and retraction system is operable to enable the golf ball to extend approximately twelve (12) inches from the opening; wherein the extension and retraction system is operable to provide the golf ball free movement in a vertical and a horizontal direction during a back stroke and a fore stroke.

2. The putter training apparatus of claim 1, wherein the extension and retraction system comprises a metal strand.

3. The putter training apparatus of claim 1, wherein the extension and retraction system comprises an elastic material.

4. The putter training apparatus of claim 1, wherein the mallet substantially bisects a center axis of the golf ball.

5. The putter training apparatus of claim 1, further comprising the extension and retraction system operable to return the golf ball to the opening at the conclusion of the stroke.

* * * * *